US005531439A

United States Patent [19]

Azzarella

[11] Patent Number: 5,531,439

[45] Date of Patent: Jul. 2, 1996

[54] GOLF PUTTER

[76] Inventor: Charles W. Azzarella, R.D. 1, Pulaski, Pa. 16143

[21] Appl. No.: 519,295

[22] Filed: Aug. 25, 1995

[51] Int. Cl.[6] ..... A63B 53/02; A63B 53/04

[52] U.S. Cl. ..... 473/331; 473/340; 473/342

[58] Field of Search ..... 273/167 S, 173, 273/174, 175, 167 G, 80 C

[56] References Cited

U.S. PATENT DOCUMENTS 2,926,913 3/1960 Stecher ..... 273/167 J X
4,027,885 6/1977 Rogers ..... 273/173 X
4,999,000 3/1991 Finney ..... 273/173 X

FOREIGN PATENT DOCUMENTS 2185891 8/1987 United Kingdom ..... 273/173

*Primary Examiner*—George J. Marlo

[57] ABSTRACT

A putter for imparting rotation to a golf ball during putting. The inventive device includes a club handle with a sole plate attached to a lower end thereof. A face plate projects from a forward edge of the sole plate and is oriented at an orthogonal angle relative thereto. A frictional insert is mounted within a slot of the face plate and operates to frictionally engage a golf ball to impart a rotation to the ball during impact.

1 Claim, 3 Drawing Sheets

GOLF PUTTER

BACKGROUND OF THE INVENTION

1. Field of the Invention

The present invention relates to golf clubs and more particularly pertains to a stainless steel insert golf putter for imparting rotation to a golf ball during putting.

2. Description of the Prior Art

The use of golf clubs is known in the prior art. More specifically, golf clubs heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf clubs include U.S. Pat. Nos. 5,332,223; 5,308,068; 4,881,737; 5,090,698; 5,193,806; and 4,776,594.

While these devices fulfill their respective, particular objectives and requirements, the aforementioned patents do not disclose a stainless steel insert golf putter for imparting rotation to a golf ball during putting which includes a club handle having a sole plate attached to a lower end thereof, a face plate projecting from a forward edge of the sole plate and being oriented at an orthogonal angle relative thereto, and a frictional insert mounted within a slot of the face plate for frictionally engaging a golf ball to impart a rotation to the ball during impact.

In these respects, the stainless steel insert golf putter according to the present invention substantially departs from the conventional concepts and designs of the prior art, and in so doing provides an apparatus primarily developed for the purpose of imparting rotation to a golf ball during putting.

SUMMARY OF THE INVENTION

In view of the foregoing disadvantages inherent in the known types of golf clubs now present in the prior art, the present invention provides a new stainless steel insert golf putter construction wherein the same can be utilized for imparting rotation to a golf ball during putting so as to cause the golf ball to assume a straight course across a green. As such, the general purpose of the present invention, which will be described subsequently in greater detail, is to provide a new stainless steel insert golf putter apparatus and method which has many of the advantages of the golf clubs mentioned heretofore and many novel features that result in a stainless steel insert golf putter which is not anticipated, rendered obvious, suggested, or even implied by any of the prior art golf clubs, either alone or in any combination thereof.

To attain this, the present invention generally comprises a putter for imparting rotation to a golf ball during putting. The inventive device includes a club handle with a sole plate attached to a lower end thereof. A face plate projects from a forward edge of the sole plate and is oriented at an orthogonal angle relative thereto. A frictional insert is mounted within a slot of the face plate and operates to frictionally engage a golf ball to impart a rotation to the ball during impact.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stainless steel insert golf putter apparatus and method which has many of the advantages of the golf clubs mentioned heretofore and many novel features that result in a stainless steel insert golf putter which is not anticipated, rendered obvious, suggested, or even implied by any of the prior art tool guides, either alone or in any combination thereof.

It is another object of the present invention to provide a new stainless steel insert golf putter which may be easily and efficiently manufactured and marketed.

It is a further object of the present invention to provide a new stainless steel insert golf putter which is of a durable and reliable construction.

An even further object of the present invention is to provide a new stainless steel insert golf putter which is susceptible of a low cost of manufacture with regard to both materials and labor, and which accordingly is then susceptible of low prices of sale to the consuming public, thereby making such stainless steel insert golf putters economically available to the buying public.

Still yet another object of the present invention is to provide a new stainless steel insert golf putter which provides in the apparatuses and methods of the prior art some of the advantages thereof, while simultaneously overcoming some of the disadvantages normally associated therewith.

Still another object of the present invention is to provide a new stainless steel insert golf putter for imparting rotation to a golf ball during putting to achieve a straight shot.

Yet another object of the present invention is to provide a new stainless steel insert golf putter which includes a club handle having a sole plate attached to a lower end thereof, a face plate projecting from a forward edge of the sole plate and being oriented at an orthogonal angle relative thereto, and a frictional insert mounted within a slot of the face plate for frictionally engaging a golf ball to impart a rotation to the ball during impact.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an enlarged isometric illustration of a portion of the present invention.

DESCRIPTION OF THE PREFERRED EMBODIMENT

Figure 1:
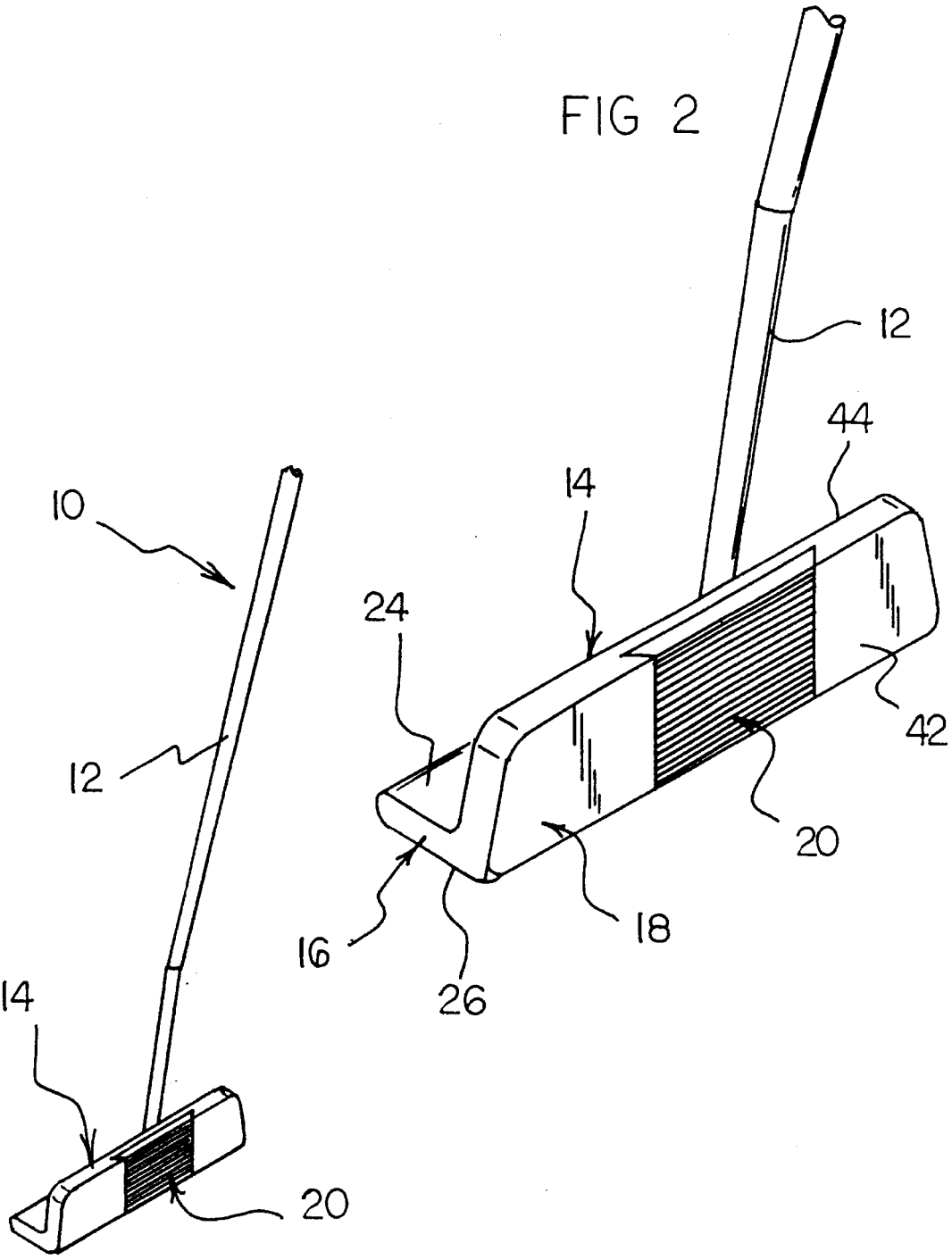
FIG. 1 is an isometric illustration of a stainless steel insert golf putter according to the present invention.

With reference now to the drawings, and in particular to FIGS. 1–6 thereof, a new stainless steel insert golf putter embodying the principles and concepts of the present invention and generally designated by the reference numeral 10 will be described.

More specifically, it will be noted that the stainless steel insert golf putter 10 comprises an elongated handle 12 for being grasped and manipulated by an individual during use of the device 10. A club head 14 is mounted to a lower end of the handle 12, as shown in FIGS. 1 and 2 of the drawings. The club head 14 includes a sole plate 16 and a face plate 18 projecting from a forward edge of the sole plate and oriented so as to extend at an orthogonal angle relative to the sole plate. A frictional insert 20 is positioned within a slot 22 (see FIG. 5) of the face plate 18 and operates to frictionally engage a golf ball during impacting thereof so as to impart a rotation to the ball causing the ball to assume a straight course. By this structure, an individual putting a golf ball can achieve greater accuracy during the shot.

Figure 3:
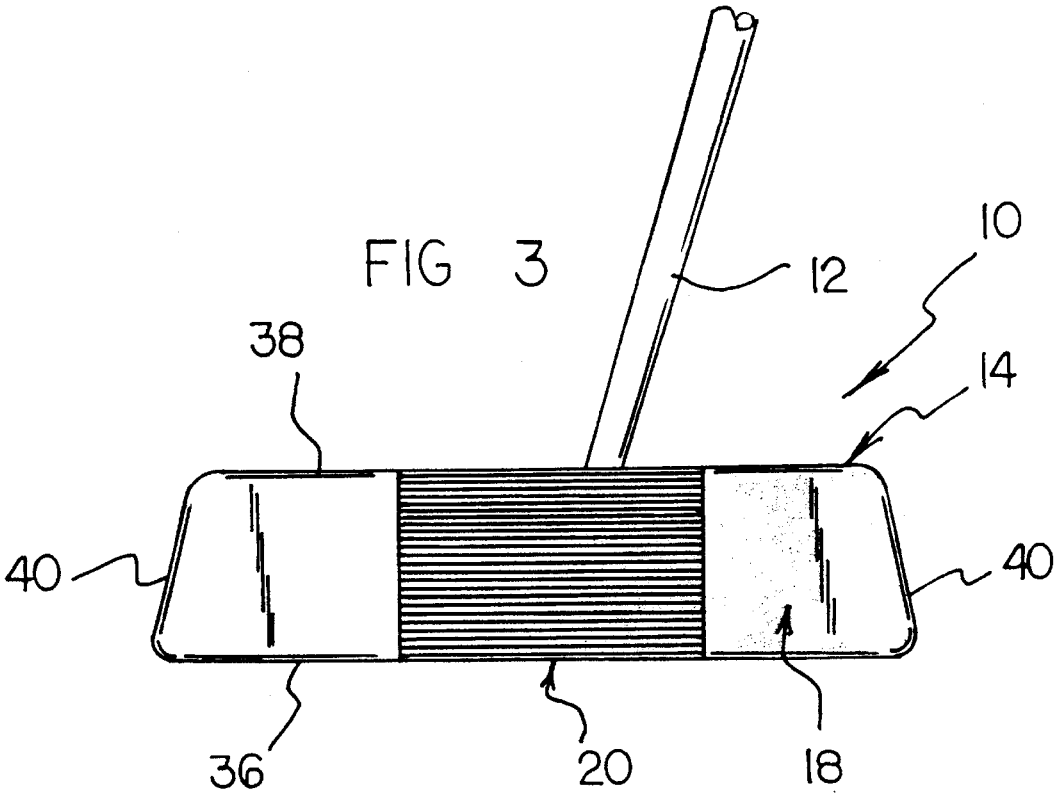
FIG. 3 is a front elevation view of the portion of the invention illustrated in FIG. 2.
Figure 4:
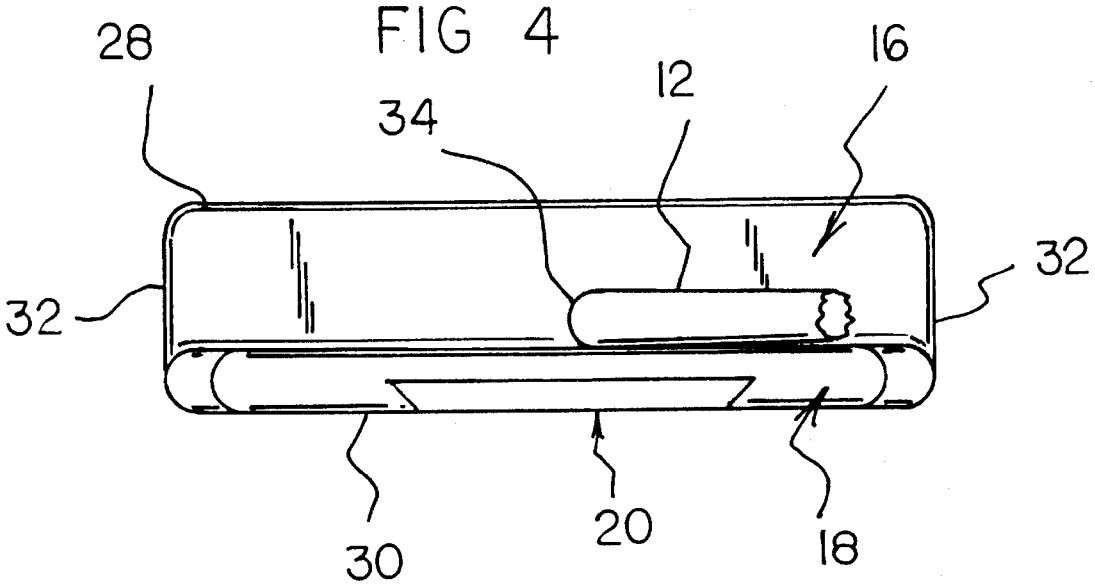
FIG. 4 is a top plan view thereof.

Referring now to FIGS. 2 through 4 wherein the club head 14 of the present invention 10 is illustrated in detail, it can be shown that the sole plate 16 is shaped so as to define a top face 24 spaced from a planar bottom face 26. A rear edge 28 is spaced from a forward edge 30 of the sole plate 16, with orthogonal lateral edges 32 extending substantially orthogonally between opposed ends of the rear edge 28 and the forward edge 30. The sole plate 16 is further shaped so as to define a hosel 34 directed thereinto and located medially between the orthogonal lateral edges 32 which receives and engages a lower end of the handle 12 by a threaded engagement, an adhesive engagement, or other mechanical fastening means.

Figure 5:
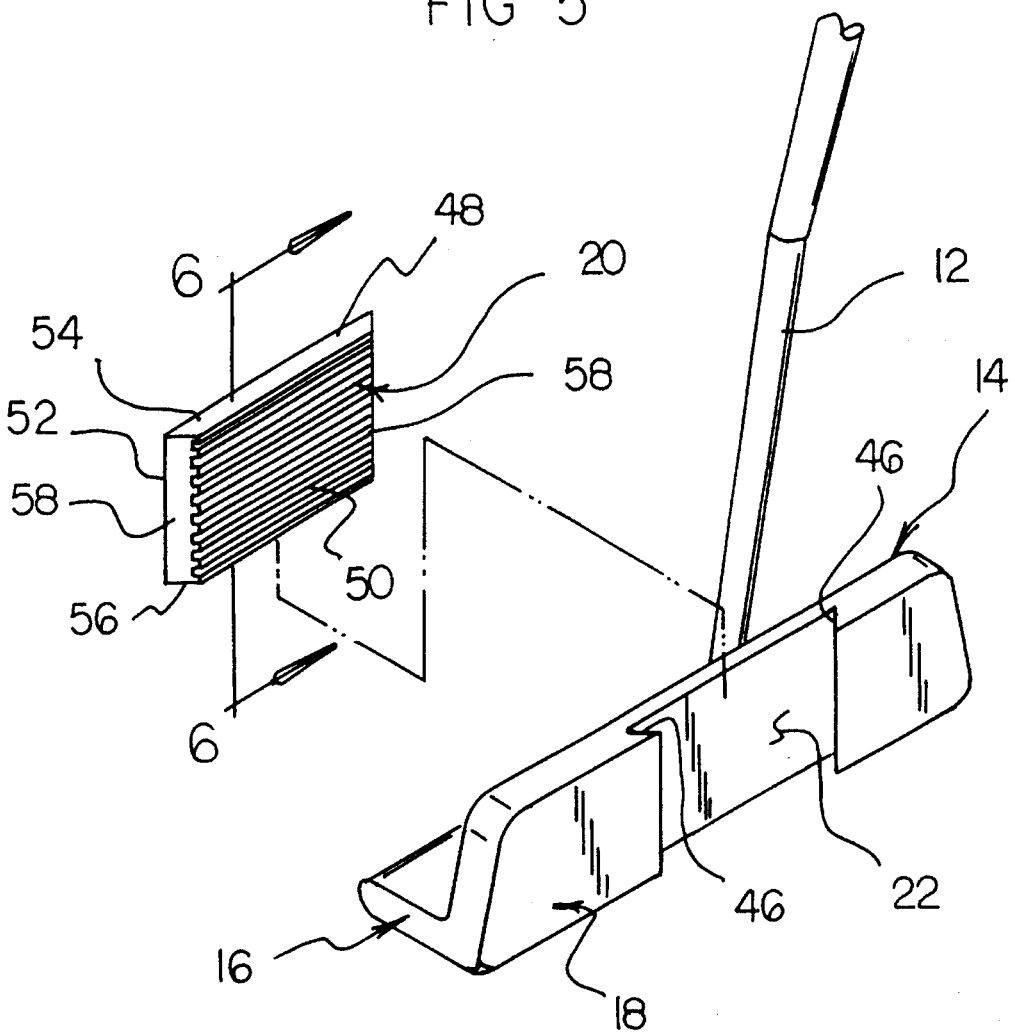
FIG. 5 is an exploded isometric illustration of the invention.

With continuing reference to FIGS. 2 through 4, it can be shown that the face plate 18 of the club head 14 is shaped so as to define a linear lower edge 36 spaced from an upper edge 38. Lateral edges 40 extend between the upper edge 38 and the lower edge 36 and are preferably oriented at an oblique angle relative to the lower edge so as to define a substantially trapezoidal shape of the face plate 18. The lower edge 36 is oriented so as to extend into contiguous communication with the planar bottom face 26 of the sole plate 16. The face plate 18 is further shaped so as to define a planar front face 42 spaced from a rear face 44. As shown in FIG. 5, the receiving slot 22 is directed into the front face 42 of the face plate 18 and extends through the face plate 18 to terminate proximal to a juncture of the face plate 18 and the sole plate 16 of the club head 14. The receiving slot 22 is shaped so as to define opposed and substantially parallel dovetail channels 46 extending vertically and parallel through the front face 42 along respectively opposed sides of the receiving slot 22 from the upper edge 38 of the face plate 18.

Figure 6:
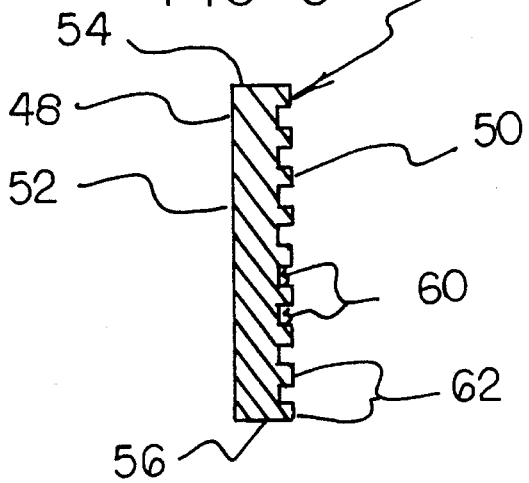
FIG. 6 is a cross-sectional view taken along line 6—6 of FIG. 5.

Referring now to FIG. 6 with concurrent reference to FIG. 5, it can be shown that the frictional insert 20 is accordingly shaped so as to fit into and frictionally engage surfaces of the receiving slot 22. To this end, the frictional insert 20 comprises a plate member 48 having a planar front face 50 spaced from a planar rear face 52. A top edge 54 extends substantially orthogonally between the front face 50 and the rear face 52, with a bottom edge 56 extending in a substantially spaced and parallel orientation relative to the top edge 54. The plate member 48 is further shaped so as to define dovetail lateral edges 28 extending from the front face 50 at an oblique angle relative thereto and into communication with the rear face 52. Accordingly, the front face 50 is of a first width, with the rear face being of a second width measured between the lateral edges 58, wherein the second width is substantially greater than the first width so as to define the dovetail lateral edges 58 extending between the front face 50 and the rear face 52. The dovetail lateral edges 58 operate to be received within the dovetail channels 46 of the face plate 18 so as to secure the plate member 48 therewithin. To this end, the plate member 48 can simply be positioned vertically into the receiving slot 22 as indicated by the guide lines of FIG. 5. The plate member 48 is shaped so as to frictionally engage surfaces of the receiving slot 22 so as to preclude removal of the frictional insert 20 therefrom.

As shown in FIG. 6, the front face 50 of the plate member 48 is shaped so as to define a plurality of grooves 60 extending between the dovetail lateral edges 58. The grooves 60 are oriented in a substantially spaced and parallel orientation relative to one another and cooperate to define a plurality of projections 62 similarly extending between the dovetail lateral edges 58 of the plate member 48. Preferably, the grooves 60 are substantially square or rectangular when viewed in cross section as shown in FIG. 6 such that the projections 62 are also substantially square or rectangular in cross section. Thus, each of the projections 62 includes a pair of spaced and parallel orthogonally oriented corner edges which frictionally engage the exterior surface of the golf ball during putting thereof.

In use, the stainless steel insert golf putter 10 of the present invention can be easily utilized for imparting a rotational spin to a golf ball during putting thereof relative to an angle of impact of the face plate 18 against the associated golf ball.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stainless steel insert golf putter comprising:

an elongated handle;

a club head mounted to a lower end of the handle, the club head including a sole plate and a face plate projecting from a forward edge of the sole plate, the face plate being shaped so as to define a receiving slot directed thereinto, the face plate is oriented so as to extend at an orthogonal angle relative to the sole plate, the face plate of the club head is shaped so as to define a linear lower edge spaced from an upper edge, with lateral edges extending between the upper edge and the lower edge, the lateral edges of the face plate being oriented so as to extend at an oblique angle relative to the lower edge so as to define a substantially trapezoidal shape of the face plate;

the sole plate is shaped so as to define a top face spaced from a planar bottom face, a rear edge spaced from a forward edge of the sole plate, and orthogonal lateral edges extending substantially orthogonally between adjacent ends of the rear edge and the forward edge, the sole plate is further shaped so as to define a hosel directed thereinto and located medially between the orthogonal lateral edges, the hosel receiving and engaging a lower end of the handle;

the lower edge of the face plate extends into contiguous communication with the planar bottom face of the sole plate, the face plate being further shaped so as to define a planar front face spaced from a rear face, with the receiving slot being directed into the front face of the face plate and extending through the face plate to terminate proximal to a juncture of the face plate and the sole plate of the club head;

the receiving slot is shaped so as to define opposed and substantially parallel dovetail channels extending vertically and parallel through the front face along respectively opposed sides of the receiving slot from the upper edge of the face plate;

a frictional insert positioned within the slot of the face plate for frictionally engaging a golf ball during impacting thereof so as to impart a rotation to the ball, the frictional insert is shaped so as to fit into and frictionally engage surfaces of the receiving slot, the frictional insert being formed of stainless steel and having a plate member with a planar front face spaced from a planar rear face;

a top edge extending substantially orthogonally between the front face and the rear face, and a bottom edge extending in a substantially spaced and parallel orientation relative to the top edge, the plate member being further shaped so as to define dovetail lateral edges extending from the front face at an oblique angle relative thereto and into communication with the rear face, wherein the front face is of a first width measured between the lateral edges, and the rear face is of a second width measured between the lateral edges, with the second width being substantially greater than the first width so as to define the dovetail lateral edges extending between the front face and the rear face, the dovetail lateral edges operate to be received within the dovetail channel of the face plate; and the front face of the plate member is shaped so as to define a plurality of grooves extending between the dovetail lateral edges, with the grooves being oriented in a substantially spaced and parallel orientation relative to one another and cooperating to define a plurality of projections extending between the dovetail lateral edges of the plate member, the grooves are substantially rectangular in cross section so as to define projections which are substantially rectangular in cross section, each of the projections having a pair of spaced and parallel orthogonally oriented corner edges which frictionally engage the exterior surface of the golf ball.

* * * * *